US007568431B1

(12) United States Patent
Stria

(10) Patent No.: US 7,568,431 B1
(45) Date of Patent: Aug. 4, 2009

(54) MULTI-PURPOSE PYROTECHNIC TRAINER

(75) Inventor: Ronald M. Stria, Washington, NJ (US)

(73) Assignee: Pacific Coast Systems, Asbury, NJ (US)

( * ) Notice: Subject to any disclaimer, the term of this patent is extended or adjusted under 35 U.S.C. 154(b) by 164 days.

(21) Appl. No.: 10/713,127

(22) Filed: Nov. 14, 2003

Related U.S. Application Data

(60) Provisional application No. 60/439,478, filed on Jan. 13, 2003.

(51) Int. Cl.
*F42B 4/18* (2006.01)

(52) U.S. Cl. ..... 102/355; 434/16; 89/1.11; 102/202.14

(58) Field of Classification Search ..... 434/11, 434/16, 22; 89/1.1, 1.41, 1.11; 102/335, 102/340, 343, 349, 351, 355, 357, 202.5, 102/206, 202.14; 42/84, 106, 49.01
See application file for complete search history.

(56) References Cited

U.S. PATENT DOCUMENTS

| | | | | | |
|---|---|---|---|---|---|
| 1,370,193 | A | * | 3/1921 | Crocker | 200/83 R |
| 2,396,699 | A | * | 3/1946 | Hayes et al. | 200/61.01 |
| 2,421,491 | A | * | 6/1947 | Gearon et al. | 89/1.1 |
| 2,526,670 | A | * | 10/1950 | Kissinger et al. | 102/402 |
| 2,717,533 | A | * | 9/1955 | Wells | 89/1.51 |
| 2,962,965 | A | * | 12/1960 | Farnsworth et al. | 102/420 |
| 3,054,870 | A | * | 9/1962 | Wagoner | 200/61.45 R |
| 3,336,870 | A | * | 8/1967 | Gunyan et al. | 102/342 |
| 3,535,809 | A | * | 10/1970 | Hoffmann | 42/106 |
| 3,721,190 | A | * | 3/1973 | Homza | 102/402 |
| 3,752,082 | A | * | 8/1973 | Kernan | 102/342 |
| 3,808,940 | A | * | 5/1974 | Schillreff et al. | 89/1.1 |
| 4,217,717 | A | * | 8/1980 | Canty et al. | 42/106 |
| 4,245,403 | A | * | 1/1981 | Hipp | 434/11 |
| 4,307,665 | A | * | 12/1981 | Block et al. | 102/505 |
| 4,325,304 | A | | 4/1982 | Ormiston | |
| 4,342,556 | A | * | 8/1982 | Hasse | 434/22 |
| 5,117,731 | A | * | 6/1992 | Mendenhall | 89/1.816 |

(Continued)

FOREIGN PATENT DOCUMENTS

| | | | |
|---|---|---|---|
| DE | 3506412 | A1 * | 8/1986 |

OTHER PUBLICATIONS

U.S. Appl. No. 12/324,405 for Mine-Like Explosion Simulator, filed Nov. 26, 2008—Application and Figures as filed.

(Continued)

*Primary Examiner*—Troy Chambers
(74) *Attorney, Agent, or Firm*—Greenberg Traurig, LLP

(57) ABSTRACT

An apparatus or device for simulating weapons firing/hit indications for military training which uses pyrotechnic devices to simulate target hits and hostile fire. The device in accordance with an embodiment of the present invention, can be used with blank ammunition. The combination of the device and the blank ammunition can offer both audio and visual indication of a hit in battlefield conditions and also simulate hostile fire. The device can be used for the training of military personnel. The device can provide visible and audible feedback to trainees. It can simulate hostile fire in which case the trainee must recognize the hostile fire and must be able to return fire.

15 Claims, 12 Drawing Sheets

U.S. PATENT DOCUMENTS

| | | | | | |
|---|---|---|---|---|---|
| 5,157,222 | A * | 10/1992 | La Mura et al. | 102/355 |
| 5,282,455 | A * | 2/1994 | Adamson et al. | 124/59 |
| 5,381,721 | A * | 1/1995 | Holmstrom et al. | 89/1.51 |
| 5,559,303 | A * | 9/1996 | La Mura et al. | 89/28.05 |
| 5,688,124 | A * | 11/1997 | Salzeder | 434/11 |
| 5,739,459 | A * | 4/1998 | La Mura et al. | 102/217 |
| 5,739,462 | A * | 4/1998 | Poor et al. | 102/342 |
| 6,318,350 | B1 * | 11/2001 | Williams | 124/71 |
| 6,393,990 | B1 * | 5/2002 | Fagan | 102/342 |
| 6,431,070 | B1 * | 8/2002 | La Mura | 102/202.11 |
| 6,502,343 | B2 * | 1/2003 | Cheng | 42/1.15 |
| 6,505,558 | B1 * | 1/2003 | La Mura et al. | 102/217 |
| 6,599,127 | B1 | 7/2003 | Hopmeier et al. | |
| 2006/0123684 | A1 * | 6/2006 | Bunney | 42/60 |
| 2007/0015115 | A1 | 1/2007 | Jones et al. | |
| 2007/0166667 | A1 | 7/2007 | Jones et al. | |

OTHER PUBLICATIONS

Oct. 9, 2008 Office Action received in U.S. Appl. No. 11/427,855 for Simulating an Explosion of an Improvised Explosive Device, filed Jun. 30, 2006.

PCT Notification of Transmittal of the ISR and the WO of the International Searching Authority in PCT/US2007/071063, dated Oct. 7, 2008 (16 pages).

* cited by examiner

MULTI-PURPOSE PYROTECHNIC TRAINER

CROSS REFERENCE TO RELATED APPLICATION(S)

This application claims the priority of provisional patent application Ser. No. 60/439,478, filed on Jan. 13, 2003, inventor Ronald Michael Stria.

FIELD OF THE INVENTION

This invention relates to improved methods and apparatus concerning the training of military personnel.

BACKGROUND OF THE INVENTION

The military utilizes pyrotechnic devices in its training to simulate target hits. Blank ammunition is used during this training. Known pyrotechnic devices for simulating military target hits are provided with a magazine for receiving a plurality of pyrotechnic devices. Electrical ignition devices are usually achieved by a contact ohmically contacting each device on a selective basis. The drawbacks of these devices are the time consuming process of properly accommodating the correct position of the pyrotechnic, and possibly of misfiring or other impediments to the proper operation of the device due to the environmental conditions present during a given training exercise.

SUMMARY OF THE INVENTION

The present invention in one or more embodiments provides a device for simulating weapons firing/hit indications for military training which uses pyrotechnic devices to simulate target hits and hostile fire. The device in accordance with an embodiment of the present invention can be used with blank ammunition. The combination of the device and the blank ammunition can offer both audio and visual indication of a hit in battlefield conditions and also simulate hostile fire.

The present invention in one or more embodiments can be used for the training of military personnel. The present invention in one or more embodiments can provide visible and audible feedback to trainees. It can simulate hostile fire in which case the trainee must recognize the hostile fire and must be able to return fire. If a target is hit the present invention in one or more embodiments will fire the appropriate pyrotechnics to simulate a hit. If a target is hit a multiple of times the present invention in one or more embodiments will fire the appropriate pyrotechnics to simulate a kill.

DETAILED DESCRIPTION OF THE DRAWINGS

Figure 1:
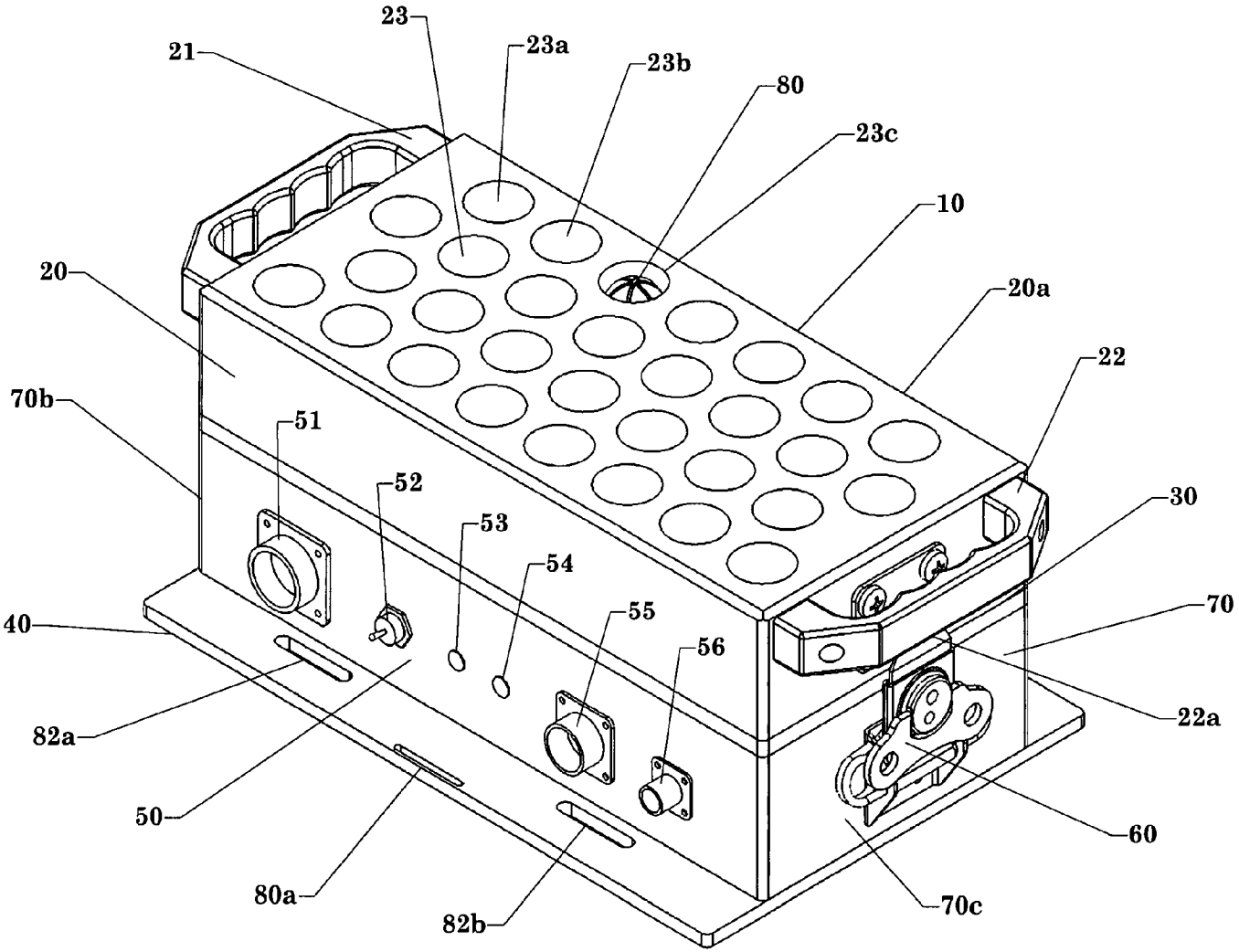
FIG. 1 shows a perspective view of an apparatus including a magazine in accordance with an embodiment of the present invention.

FIG. 1 shows a perspective view of an apparatus 10 including a magazine 20 in accordance with an embodiment of the present invention. The apparatus 10 can also be called a multi-purpose pyrotechnic trainer. The apparatus 10 includes carrying handles 21 and 22, which are attached to the magazine 20. The apparatus 10 also includes a top plate 30, which lies underneath the magazine 20. The top plate 30 is attached to an electronic housing 70, which is attached to a base plate 40.

A front control panel 50 is located at the front of the electronic housing 70. A latch assembly 60 is located on the right side of the electronic housing 70. The magazine 20 has a plurality of bores or openings 23, which includes bores 23*a*, 23*b*, and 23*c*. Each of bores 23 may have located therein a pyrotechnic cartridge, such as the pyrotechnic cartridge 80 located in the bore 23*c*.

Figure 2:
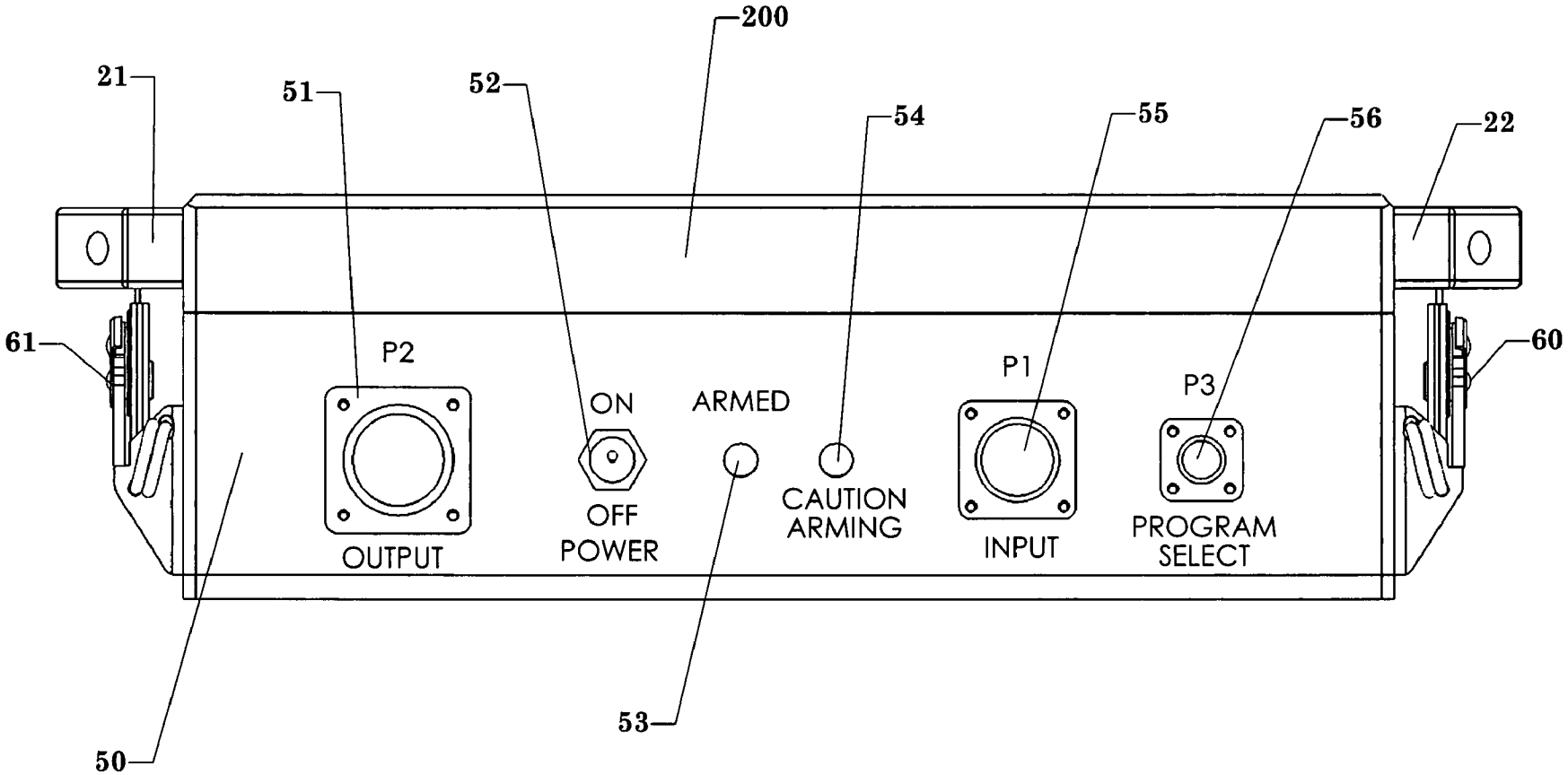
FIG. 2 shows a perspective view of a front control panel of the apparatus of FIG. 1.

FIG. 2 shows a perspective view of the front control panel 50 of the apparatus 10 of FIG. 1. The front control panel 50 includes a tandem output connector 51, a power switch 52, light emitting diodes (LEDs) 53 and 54, an input connector 55, and a programming connector 56. Tandem output connector 51 is a fourteen pin connector and is used to connect more units (like apparatus 10) together so that they are chained, so that when one unit or apparatus 10 is completely fired the second unit will continue to fire and so on. Tandem output connector 51 also supplies DC power to the next unit (or apparatus like apparatus 10) in the chain. Input connector 55 is a seven-pin connector and is where the control unit that tells the Multi-purpose pyrotechnic trainer or apparatus 10 what type of round (M30 or M31) and when to fire is connected. Input connector 55 is also used to supply DC power to the apparatus 10 from an external source. Programming connector 56 is used to connect a special programmer that changes the operational characteristics of the Multi-purpose Pyrotechnic Trainer or apparatus 10. The power switch 52 turns on the power of the apparatus 10 to make it operational which in turn allows the apparatus 10 to arm. The LED 53 emits a green light to indicate that the apparatus 10 is armed and ready to fire upon command. The LED 54 emits an amber light to indicate that power has been applied by switch 52 and that the apparatus 10 is arming or is about to be armed.

The magazine 20 and the electronic housing 70 can be considered the main components of the apparatus 10. The magazine 20 is used to hold the pyrotechnic ammunition or "rounds" of ammunition, such as the M30 or M31 rounds. The electronic housing 70 as shown in FIG. 2, includes the electronic fire control circuit board and interface board (not shown in any details) housed inside of the electronic housing 70, the input connector 55, which is used to supply DC power and also the control signals to apparatus 10, the output connector 51 which is used to interface with another apparatus similar or identical to apparatus 10, the power switch 52 used to control DC power to the apparatus 10, and visual indicator LED's 53 and 54.

Figure 3:
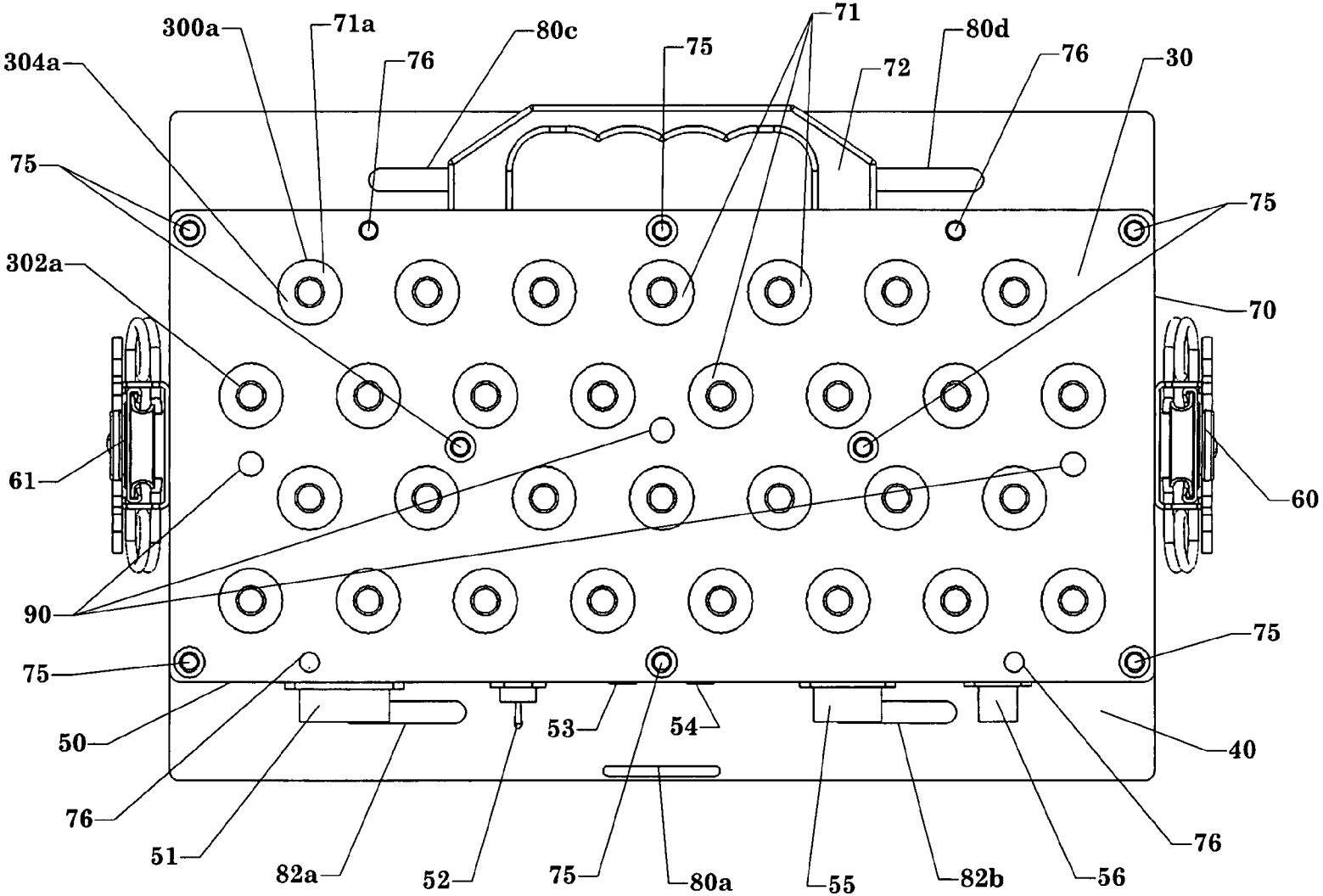
FIG. 3 shows a top view of the apparatus of FIG. 1 without the magazine attached to the apparatus of FIG. 1.

FIG. 3 shows a top view of the apparatus 10 of FIG. 1 without the magazine 20 attached to the apparatus 10. FIG. 3 shows a plurality of conductive material disc pads 71, such as pad 71*a*, which are imbedded into the top plate 30, which in turn is attached to the electronic housing 70 of FIG. 1. The electronic housing 70 includes an electronic housing handle 72, which is located in the back of the electronic housing 70. FIG. 3 also shows a latch catch slot 80*a* for attaching the apparatus 10 to a tilt able stand, such as a stand 100 in FIG. 5 via latch assembly 102*a* and 102*b* of FIG. 5. The conductive material disc pads 71 are located on the top plate 30. The conductive material pads 71 allow conduction to the top plate 30 which is electrically common (all pads are also electrically common) and the pads 71 also allow for any variation in the length of the outer contact pins, such as 406 of FIG. 11 or 409 of FIG. 12. FIG. 3 also shows the three safety interlock contact pads 90 which are used to determine if the magazine 20 of FIG. 1 has been properly latched down. The eight bolts 75 which are used to fasten the top plate 30 to the housing 70 are also shown. In addition the four locating bolts 76 that may protrude approximately ¼ inch above the top plate 30 are shown.

Figure 4:
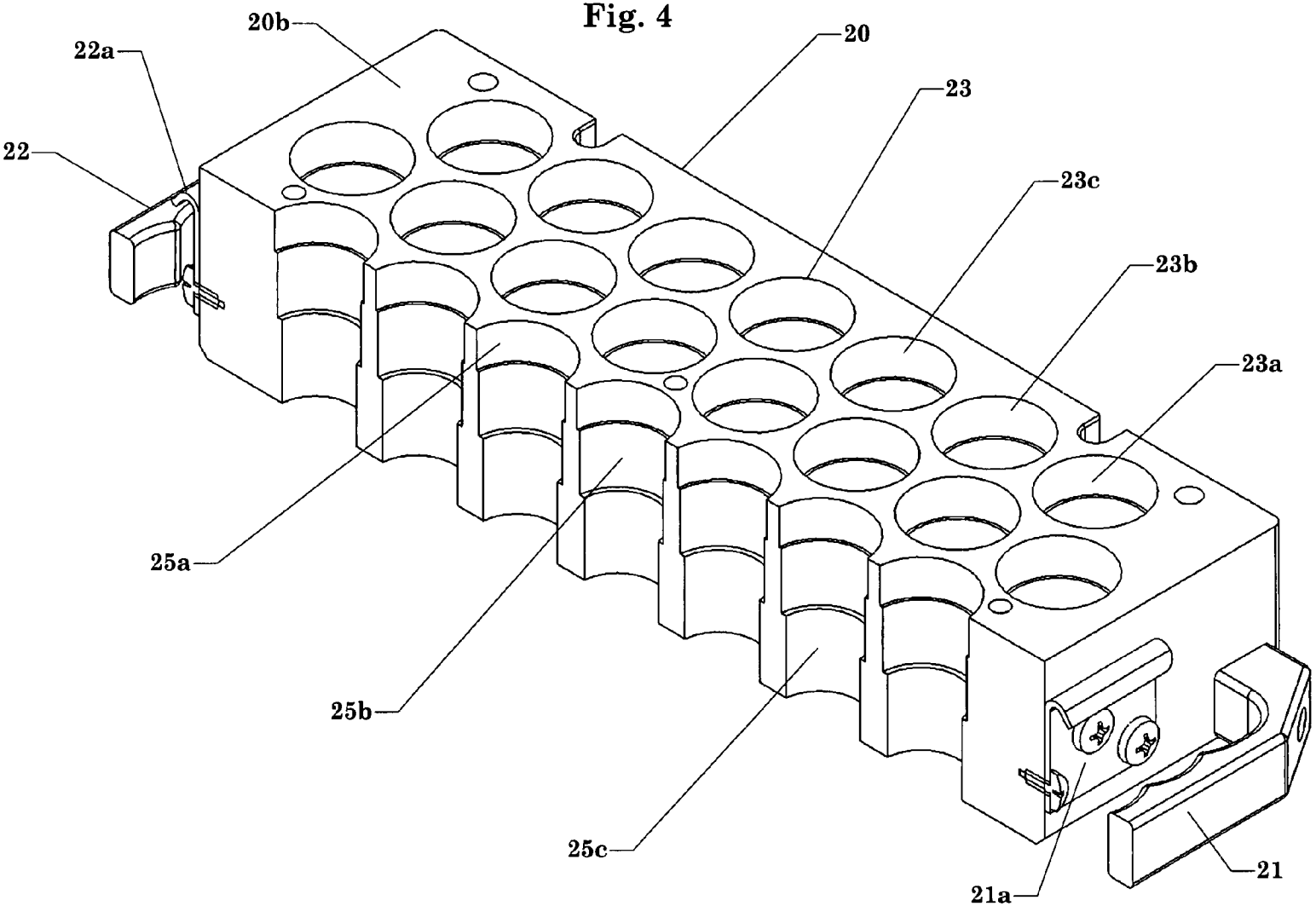
FIG. 4 shows a perspective view of a cross section of the magazine used in FIG. 1.

FIG. 4 shows a perspective view of a cross section of the magazine 20 used in FIG. 1. The magazine 20 has a plurality of bores or borings 23 such as boring 23*a*, 23*b*, and 23*c*. Each of borings 23, is comprised of a boring 25*a* for an M30 pyrotechnic device and a boring 25*b* for an M31 pyrotechnic device. The boring 25*a* may have a diameter of approximately 1.337" and it accepts the diameter created by component 401 of FIG. 12. The boring 25*b* may have a diameter of approximately 1.263" and accepts the diameter created by component 400 of FIG. 11. The boring 25*c* is used to accept the diameters created by component 402 of FIG. 11 and FIG. 12 which are equal in size and may have a diameter of approximately 1.121". The ability to accept both types of pyrotechnic rounds (M30/31) in one magazine 20 in any one of the chambers, such as chamber 23 of FIG. 4, of that magazine 20 is a unique feature of one or more embodiments of the present invention.

Figure 5:
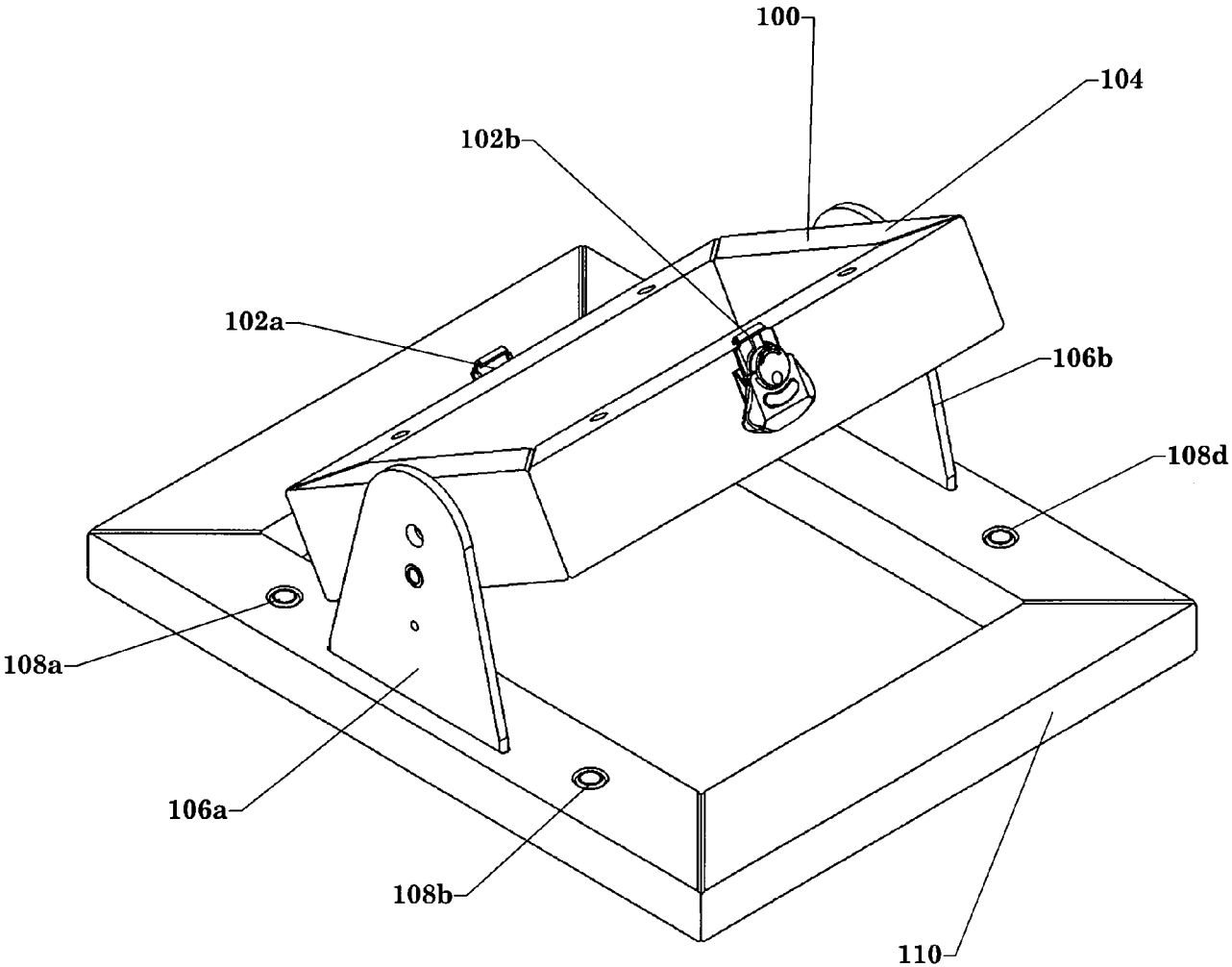
FIG. 5 shows a perspective view of a stand for use with the embodiment of FIG. 1.

FIG. 5 shows a perspective view of the tilt able stand 100 for use with the embodiment of FIG. 1. The stand 100 includes latches 102*a* and 102*b*, a tilt able top frame 104, uprights 106*a* and 106*b*, mounting holes 108*a*-*d*, and base frame 110. The stand 100 can be made of aluminum or aluminum tubing and the top frame 104 may be capable of being tilted zero, thirty and forty-five degrees in either direction with respect to the base frame 110. There are no open holes to the inside of the tubing of the stand 100 to keep sand and any foreign material from getting into the stand 100.

Figure 6:
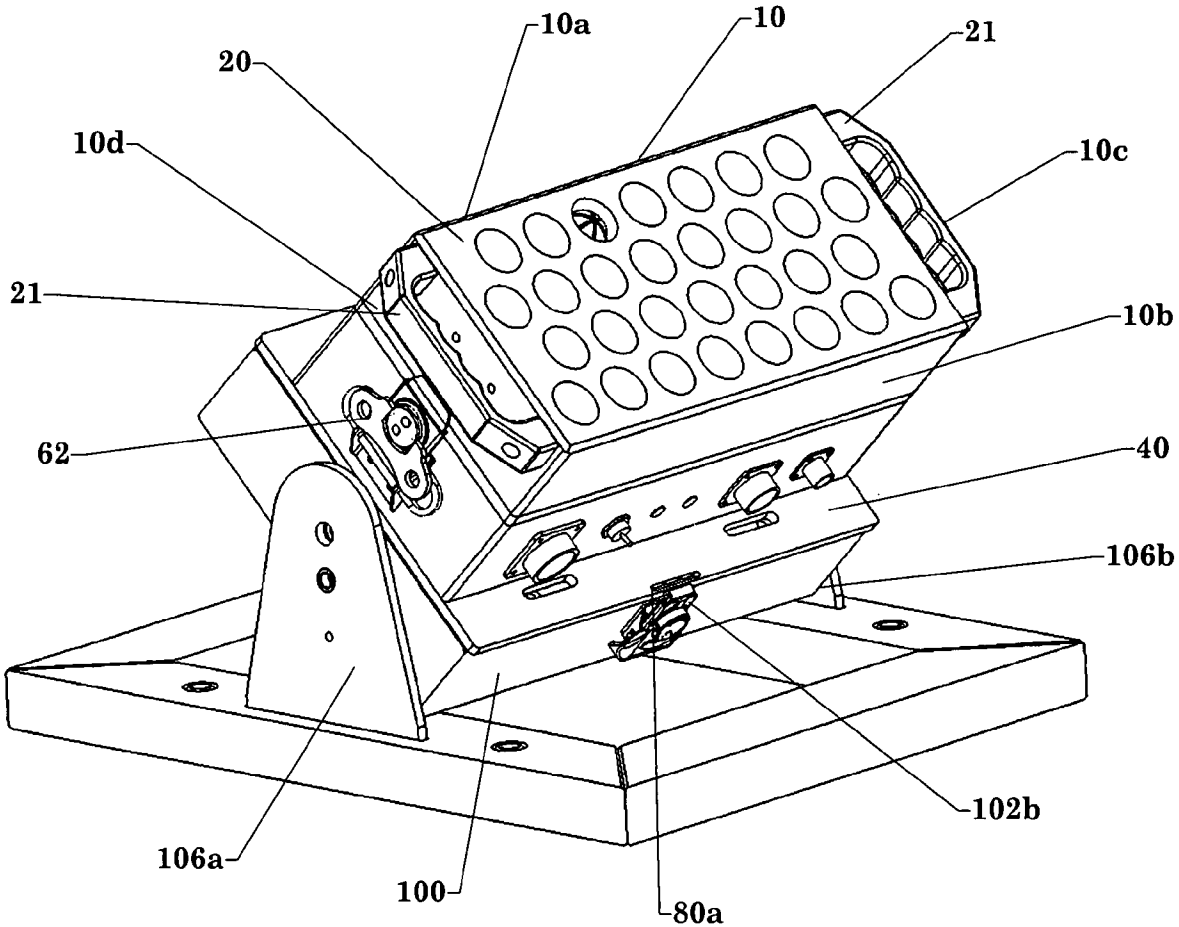
FIG. 6 shows a perspective view of the apparatus of FIG. 1 mounted on the stand of FIG. 5.

FIG. 6 shows a perspective view of the apparatus 10 of FIG. 1 mounted on the stand 100 of FIG. 5. The latches 102*a* (shown in FIG. 5) and 102*b* are latched to corresponding latch catch slots on the apparatus 10 to fix the apparatus 10 to the stand 100. Latch 102*b* is latched to latch catch slot 80*a* and latch 102*b* is latched to a latch catch slot, similar to latch catch slot 80*a* but located on side 10*a* of the apparatus 10. The entire apparatus 10 can be latched to the stand 100 as shown in FIG. 6, thus raising the apparatus 10 from the ground and allowing a tilt which can enhance the sound since the apparatus 10 is being tilted towards the trainee.

Figure 7:
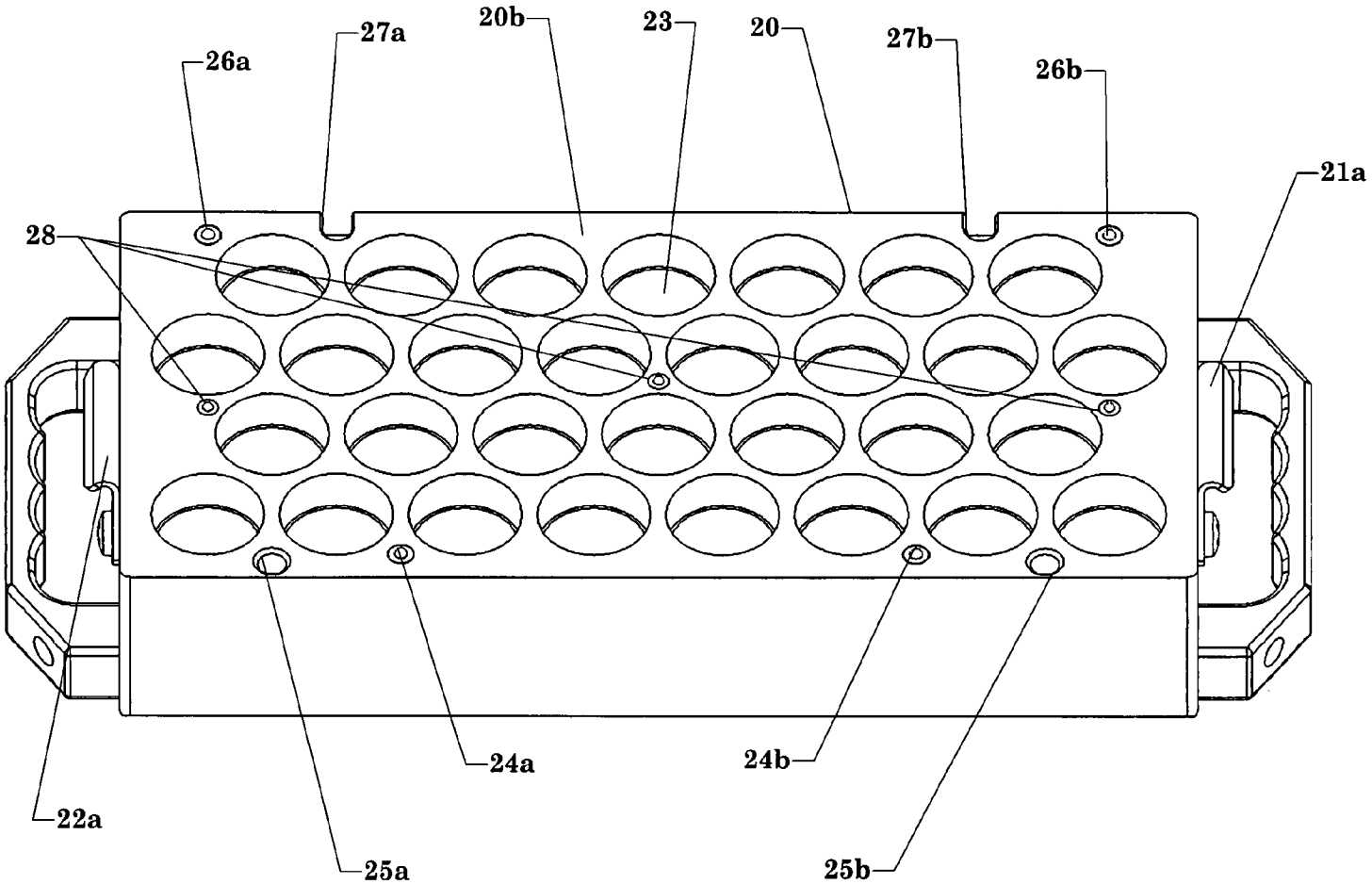
FIG. 7 shows a perspective view of the magazine used in FIG. 1.

FIG. 7 shows a perspective view of the magazine 20 used in FIG. 1. The magazine 20 includes standoff pins 24*a*, 24*b*, 26*a*, and 26*b*, which are used to keep the magazine 20 raised up so that the contact pins, such as pins 404 and 406 of FIG. 11 or pins 407 and 409 of FIG. 12, of the pyrotechnic rounds and the safety interlocks 28 do not make ohmic contact with their respective contact pads 90 unless the magazine 20 is properly latched down. This feature keeps the apparatus 10 from arming unless the magazine 20 is properly latched. The magazine 20 also includes locating features 25*a*, 25*b*, 27*a*, and 27*b* which properly align and orientate the magazine 20 to the top plate 30. There are four screw heads, 76 of FIG. 3, that protrude above the top plate surface approximately ¼ inch that have been specially altered to accept (fit into) the locating features 25*a*, 25*b*, 27*a*, and 27*b* thus allowing the magazine 20 to be mounted in only the proper orientation. Once mounted the magazine 20 cannot slide in any direction since it is locked into place by the screw heads 76, and the locating feature 25*a*, 25*b*, 27*a*, and 27*b*. However, the magazine 20 is still in the raised position via the standoff pins 24*a*, 24*b*, 26*a*, and 26*b*, until the magazine 20 is properly latched down. The magazine 20 further includes safety interlocks 28. When the magazine is properly latched down the safety interlocks 28 (shown in FIG. 7) make ohmic contact (all three must make contact) with their respect contact pads, 90 of FIG. 3, which in turn completes a circuit within the electronic housing 70 indicating that the magazine 20 is properly latched and allowing the circuitry to continue with the arming procedure. If any one of the three safety interlocks 28 does not make ohmic contact with its respective contact pad 90, indicating something is improperly latched, the apparatus 10 will enter a "fail safe" mode and never arm when power is applied. Latch keepers 21*a* and 22*a*, shown in FIG. 7, are also provided for the magazine 20. The latch keepers 21*a* and 22*a* latch-to-latch assemblies 62 and 60 to connect the magazine 20 to the top plate 30.

The magazine 20 may be comprised of the thirty bored holes 23 to accommodate the rounds. Four detent standoff pins 24*a*, 24*b*, 26*a*, and 26*b* shown in FIG. 7 may be on the underside 20*b* of the magazine 20 to keep the magazine 20 raised up off of the top plate 30 unless the magazine 20 is properly latched by latches or latch assemblies 60 and 62 to the top plate 30. Three ball detent pins 28, which are used as the safety interlocks 28, can be used to complete a circuit which signals a CPU (central processing unit) in the electronic housing 70 that the magazine 20 is properly latched to the top plate 30 by latches 60 and 62. The two keeper plates 22*a* and 21*a* are used to mate with the latches 60 and 62.

Figure 8:
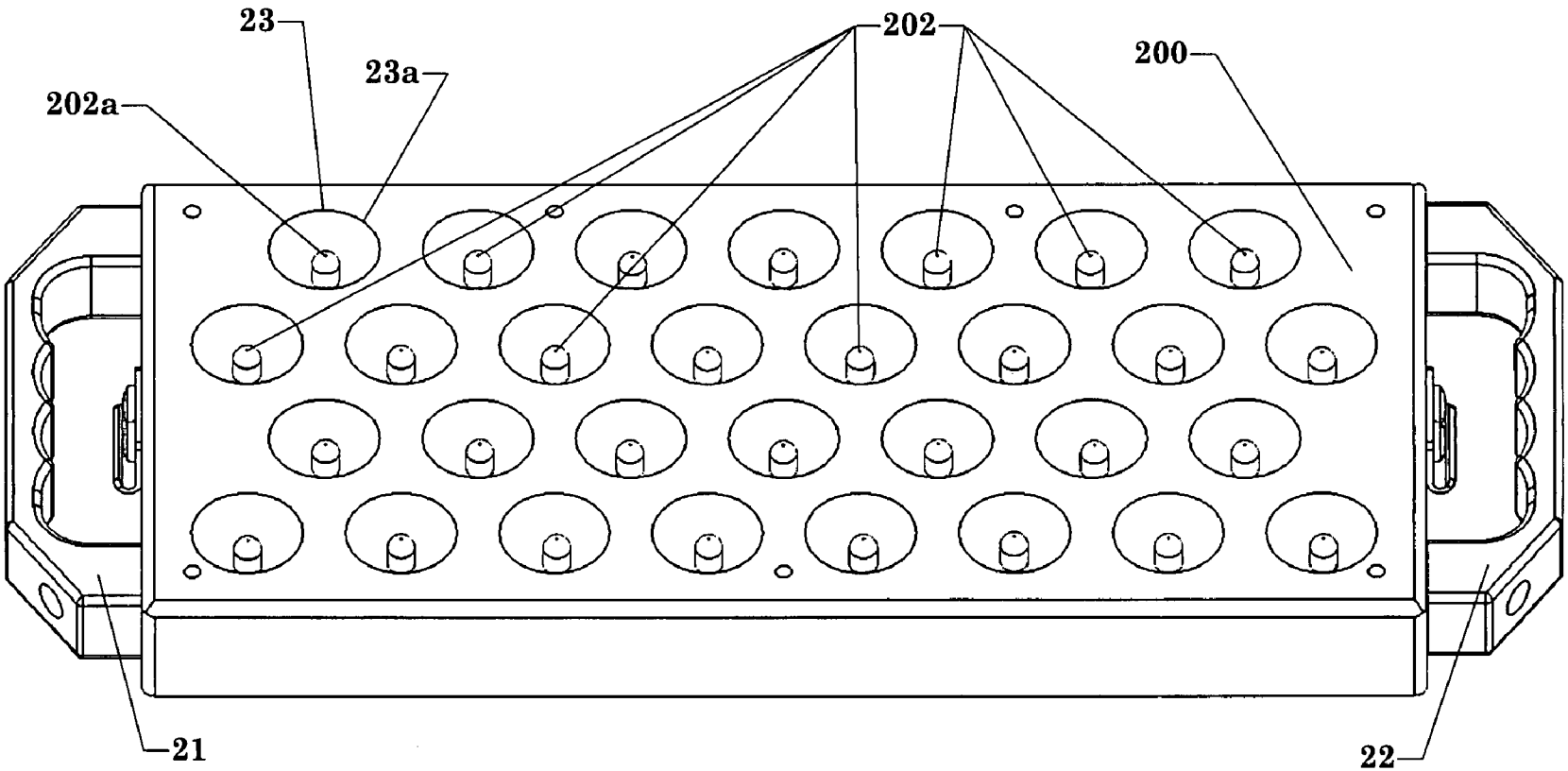
FIG. 8 shows a perspective view of a light emitting diode test block.

FIG. 8 shows a perspective view of a light emitting diode test block 200. The LED test block 200 includes a plurality of LEDs 202 including LED 202*a*. Each of the plurality of bores or openings 23, includes an LED therein, such as LED 202*a* located in bore 23*a*. The LED test block 200 can be optionally used in place of the magazine 20. The function of the LED test block 200 is to show which type of rounds are being fired, such as for example M30 or M31 type rounds or ammunition, and how many rounds are being fired at once, i.e. one or more pyrotechnics such as pyrotechnic 80. Mainly LED test block 200 is used to verify which mode has been programmed i.e. how many rounds are fired at once, and also to verify that everything is functioning properly.

Figure 9:
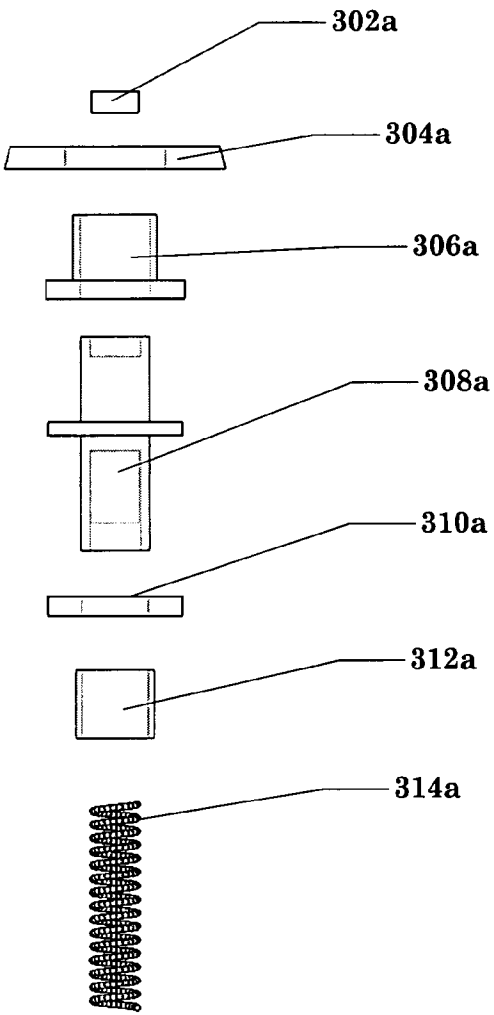
FIG. 9 shows perspective view of a cross section of a contact assembly for use in the apparatus of FIG. 1.
Figure 9:
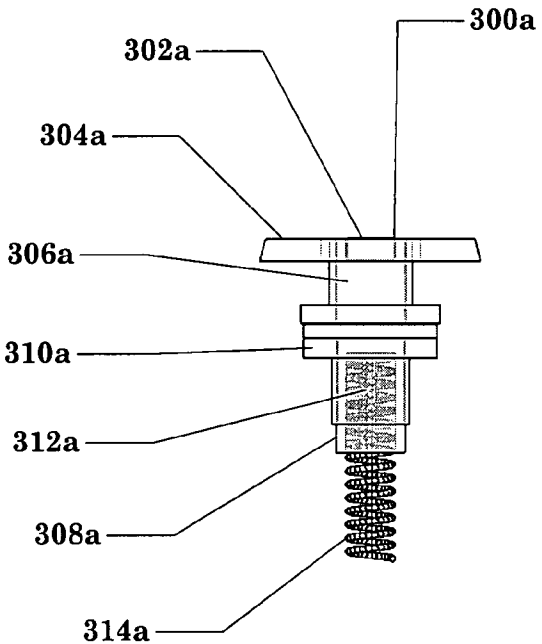

FIG. 9 shows side views of components of a contact assembly 300*a* of the plurality of contact assemblies 300, for use in the combination of the top plate 30 and the electronic housing 70. The contact assembly 300*a* includes a center conductive disc 302*a* a peripheral conductive disc 304*a*, a nylon flange bushing 306*a*, a stainless steel transfer post 308*a*, a non-conductive washer 310*a*, a nylon sleeve 312*a*, and a stainless steel bridge spring 314*a*. Components 302*a*, 308*a*, and 314*a* form a continuous electrical path from the outside of the apparatus 10 to the inside of the electronic housing 70. When a magazine 20 with rounds inserted is latched to the apparatus 10, the center contact pin 404 of a round 80 or 81 makes ohmic contact with center conductive disc 302*a*. The center conductive disc pad 302*a* in turn makes ohmic contact with the stainless steel transfer post 308*a*. The stainless steel bridge spring 314*a* completes the electrical path from the stainless steel transfer post 308*a* to the interface circuit board 75 (shown schematically in FIG. 10) inside of the electronic housing 70. The interface circuit board 75 has exposed areas that match up with and make ohmic contact with the stainless steel bridge spring 314*a*. With this arrangement the CPU can selectively fire any one of the pyrotechnic rounds inserted into the magazine 20. The peripheral conductive disc 304*a* makes ohmic contact with the outer contact post 409 of pyrotechnic round 80 or outer contact post 406 of pyrotechnic round 81 aid also with the aluminum top plate 30 which is electrically common to complete the circuit. The peripheral conductive disc 304*a* is similar in appearance to a washer. The reason being that when the operator inserts a round into the chamber 32 of the magazine 20 the outer electrode 406 or 409 of the round may be orientated anywhere Along the imaginary circle created by turning the radius between the center of the chamber and the outer electrode in a full circle. The nylon flange bushing 306*a* and nylon sleeve 312*a* are used to electrically insulate or isolate the stainless steel transfer post 308*a* from ohmically contacting the top plate 30 or the electronic housing 70. The non-conductive washer 310*a* is used to form a seal between the top plate 30 and electronic housing 70. When the top plate 30 is bolted to the electronic housing 70 the non-conductive washer is compressed against surface 72*a* of FIG. 10 to form the seal. This insures that no liquid or foreign material can enter into the electronic housing 70 via any of the bored holes such as 71*a* of FIG. 10. The contact assembly 300*a* is unique and allows the selectively addressable passage of electrical energy from within the electronic box to the outside of the electronic box to any one of the pyrotechnic rounds and does not allow any liquid or foreign material in.

Figure 10:
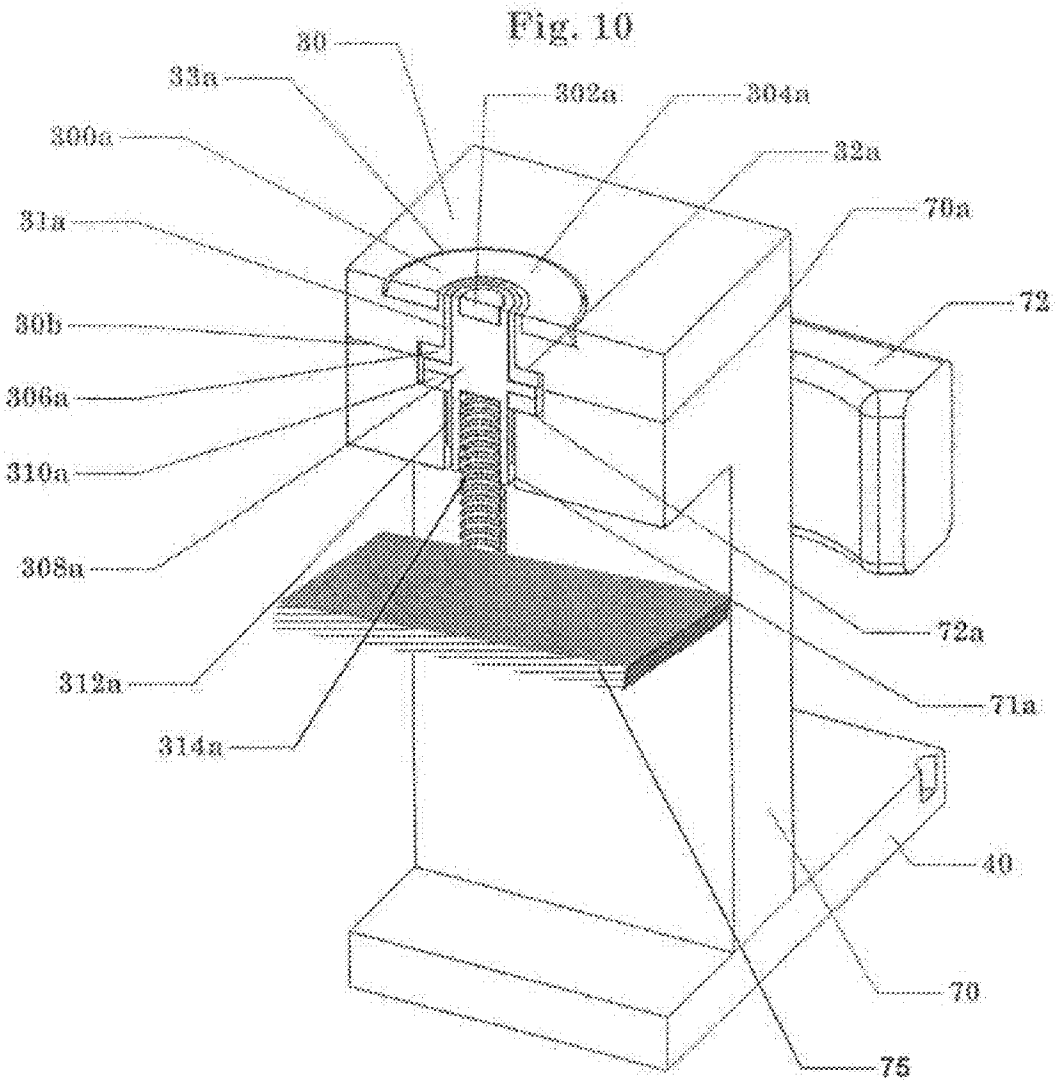
FIG. 10 shows a perspective view of a cross section of a contact assembly and part of an electronics housing for use in the apparatus of FIG. 1.

FIG. 10 shows a perspective view of a cross section of a portion of the top plate 30, the contact assembly 300*a*, the electronic housing 70, the base plate 40, and the handle 72.

The top plate 30 may be comprised of thirty bored through holes, such as through hole 31*a* shown in part in FIG. 10, to accommodate each of the contact assemblies 300, such as contact assembly 300*a* in FIG. 10. The top plate 30 may be comprised of thirty counterbores, such as counterbore 32*a* shown in FIG. 10, on the underside 30*b* of the top plate 30 to accommodate a plastic headed bushing, such as nylon flange bushing 306*a* shown in FIG. 10, which is used for insulation. The top plate 30 may be further comprised of thirty milled rings, such as milled ring 33*a* around the center-bored hole, such as hole 31*a*, (milled after anodizing to preserve the electrical characteristics of the aluminum. This makes all peripheral conductive discs 304*a* electrically common to each other and the top plate 30) which are used to hold a peripheral conductive disc 304*a* in place, such as peripheral conductive disc 304*a* shown in FIG. 9 and FIG. 10. The outer diameter of the milled rings, such as milled ring 33*a* and the outer diameter of the peripheral conductive disc 304*a*, have a fifteen-degree angle to lock the peripheral conductive discs, such as disc 304*a* in place. A top of the top plate 30 contains conductive rubber peripheral conductive discs 304*a* cylindrically applied juxtaposing the plurality of receptacles of the magazine 20 to form a plurality of electrical contact receptors.

Thirty peripheral conductive discs, such as 304*a*, which have a fifteen-degree angle on the outside diameter together act as a lock when inserted into the top plate 30. The peripheral discs make contact with the outside pin 406 of a pyrotechnic round 80 of FIG. 12 or outer contact post 409 of round 81 of FIG. 11.

The electronic housing 70 may be a housing made of an aluminum box milled from a solid with a ½" wall around five sides inverted so the closed end is up and the open end is down. The electronic housing 70 may have thirty through holes 71, such as 71*a*, in the top (closed end) 70*a*, shown by FIG. 10, which accommodate the stainless steel center contacts transfer posts such as transfer post 308*a*. The electronic housing 70 may have a counter bore around each hole, such as hole 71*a*, to accommodate a neoprene washer, such as washer 310*a*, used to seal each hole, such as hole 71*a*, when all of the entire apparatus 10 is assembled and bolted together.

The latch assemblies 60 and 61 may be rotary latches which are connected to sides 70*b* and 70*c*, respectively, of the electronic housing 70. The latch assemblies 60 and 61 may be used to pull down and secure the magazine 20 to the top plate 30.

Various tapped holes may be provided in the electronic housing 70, such as 75 to bolt the top plate 30 to the housing 70, the base plate 40 to the electronic housing 70, the three connectors 51, 55, and 56, to the housing 70, the latches 60 and 62 to the housing 70, the handles 21 and 22 to the magazine 20, and some tapped holes (not shown) on the inside of the electronic housing 70 can be provided and used to secure the interface printed circuit board (PCB) identify by number (not shown) in the electronic housing 70 and the main printed circuit board (not shown) to the electronic housing 70.

The stainless steel transfer posts, such as 308*a* or contacts may be made of stainless steel. The base plate 40 shown in FIG. 1, can be a simple aluminum plate with some holes (not shown) to allow for screws (not shown) which mount it to the electronic housing 70 and also slots, such as slots 80*a*, 80*c*, 80*d*, 82*a* and 82*b* to locate and latch the apparatus 10 to the stand 100.

Figure 11:
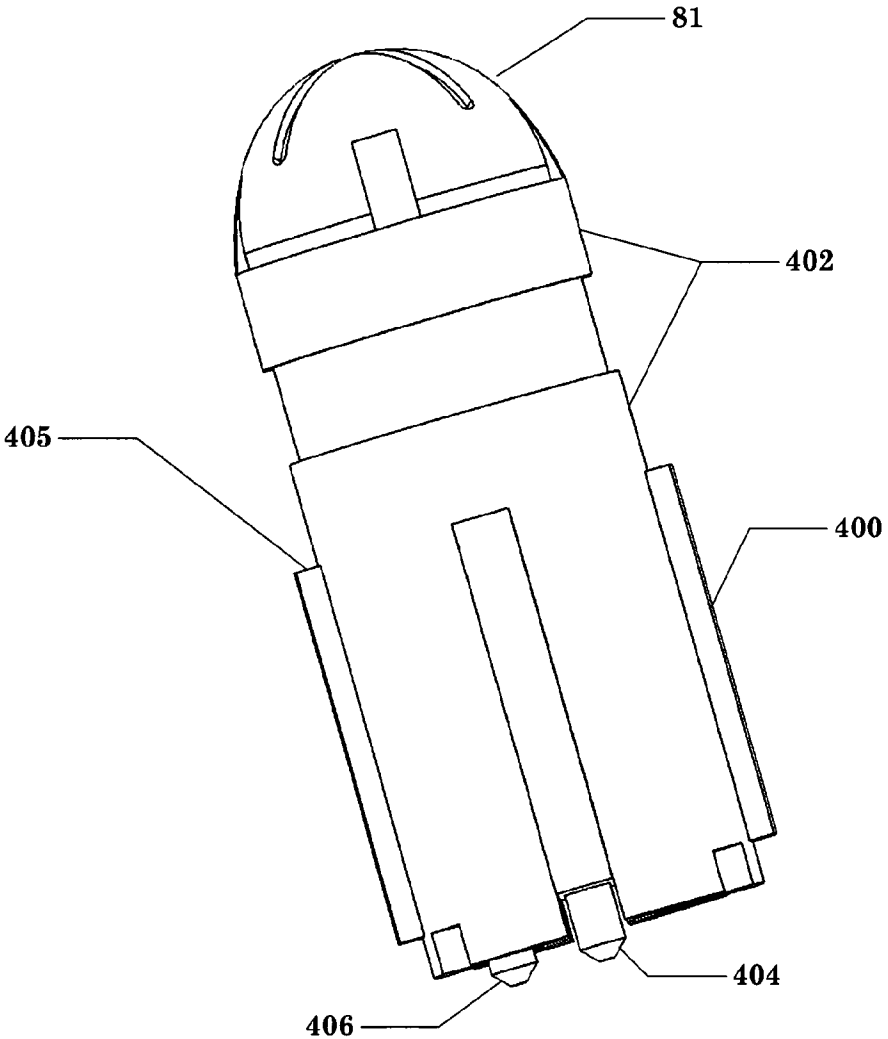
FIG. 11 shows a perspective view of the M31 type classified pyrotechnics round.
Figure 12:
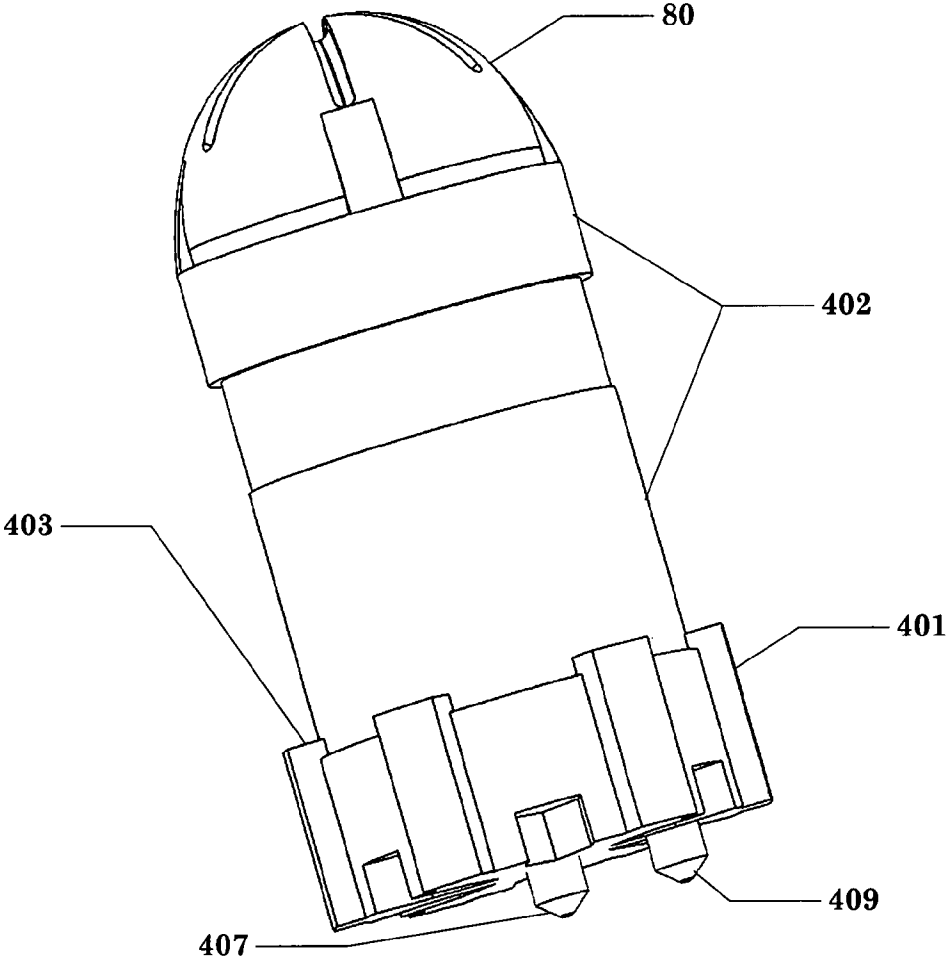
FIG. 12 shows a perspective view of the M30 type classified pyrotechnics round.

The present invention, in one or more embodiments, satisfies a need for a pyrotechnic ignition system capable of firing the existing low cost M30 and M31 Type Classified Rounds, such as 80 of FIG. 12 and 81 of FIG. 11 respectively, in a reliable, safe and effective manner, as well as performing a variety of special applications. The device of an embodiment of the present invention is comprised of two main parts. The first main part is the thirty round magazine, such as magazine 20, capable of accommodating the M30 and M31 Type Classified Rounds in any combination. The second main part is the fire control box or electronic housing 70 (the "BOX").

The device of an embodiment of the present invention typically has a magazine, such as magazine 20 which is bored in a manner to accommodate the dimensions of the Type Classified Rounds. The bottom, of each of the thirty receptacles in the magazine 20, such as receptacles 23 in magazine 20 shown in FIG. 4 and FIG. 7, is typically recessed in accordance with a shoulder, such as shoulder 405 of the M31 pyrotechnic 81 of FIG. 11 or shoulder 403 of the M30 pyrotechnic 80 of FIG. 12, such as round or pyrotechnic 80 shown in FIG. 1.

An embodiment in accordance with the present invention also assists to secure the Type Classified Round, such as 80 or 81, to the magazine 20 when loading. The magazine 20 may include two U-shaped alignment slots, such as alignment slots 27*a* and 27*b* of FIG. 7, and two bored holes, such as holes 25*a* and 25*b* of FIG. 7, to accommodate the guide bolts (not shown) located on the top plate 30. The guide bolts (not shown) protruding above the surface of the top plate 30, serve a dual purpose, to locate and orientate the magazine 20 via u-slots 27*a* and 27*b* and bored holes 25*a* and 25*b* of the magazine 20, and also to help bolt down the top plate 30 to the electronic housing 70 which will compress the neoprene washers 310*a* to form the seal between the top plate 30 and the electronic housing 70.

Three contact points, 28 can be also located on the magazine 20 to complete the circuitry with their respective contact pads 90 on the top plate 30 required for arming the apparatus 10. In addition, four detent standoff pins 24*a*, 24*b*, 26*a*, and 26*b* are also located on the horizontal axis of the magazine 20 underside 20*b* and may protrude approximately $1/16^{th}$ of an inch. The object of this design is to provide a cushion to guard against any potential damage to the apparatus 10 as a result of inadvertently slamming the magazine 20 on to the top plate 30. The detent standoff pins 24*a*, 24*b*, 26*a*, and 26*b*, will also avoid any premature arming of the apparatus 10 since the three contact points 28 on the magazine 20 will be precluded from contacting their respective contact pads 90 on the top plate 30.

The magazine 20 and the electronic housing 70 or "Box" are held in tandem by a heavy-duty adjustable locking hinge or latching assemblies 60 and 61. Proper alignment of the magazine 20 to the top plate 30 is achieved by way of four guide bolts 76 of FIG. 3 affixed to the electronic housing or Box 70. A handle, such as a black molded nylon handle 21 and 22 of FIG. 6 may be affixed to side 10*c* and 10*d* of the magazine 20 of FIG. 6. A black nylon handle, such as 72 of FIG. 3, may also be affixed to the backside 50*a* of the electronic housing 70 of FIG. 3 for ease of mobility.

The present invention in one or more embodiments provides a "button" contact assembly 300*a* of FIG. 9 specifically designed to accommodate the Type classified rounds 80 or 81 housed in the thirty round magazine 20. The two-part assembly is first comprised of a top plate 30 bored to accommodate thirty stainless steel transfer posts 308*a*. Furthermore, the top plate 30 has thirty milled pockets, such as 33*a* of FIG. 10. A conductive disc, such a peripheral conductive disc 304*a*, is inserted into the circular milled pocket 33*a*. The outside diameter of the milled slot 33*a* and the outside diameter of the peripheral conductive disc 304*a* both have a fifteen degree angle with respect to vertical which help to lock the conductive disc 304*a* into the milled pocket 33*a*. The circular milled pockets 33*a* are machined after the top plate 30 is anodized to preserve the electrically conductive characteristics of the aluminum. The circular milled pockets 33*a* of the top plate 30 are plated with an electrically conductive plating process, which may be chrome or zinc chromate, after the pockets are milled and before the peripheral conductive discs 304*a* are inserted to counteract and eliminate the natural corrosive properties of the aluminum and to further preserve the electrical characteristics of the aluminum. The center conductive pad 302*a* is inserted into each stainless steel transfer post 308*a* and cylindrically applied to the top portion 30*a* of the top plate 30 juxtaposing the receptacles 23 of the magazine 20 to form the required electrical contact receptors 300*a*. A nylon bushing, such as bushing 306*a* of FIG. 9, contained in the top plate 30 further insulates the stainless steel contact post 308*a*. The top plate 30 is affixed to the Box 70 by eight bolts, such as bolts 75 of FIG. 3, and the four guide bolts 90 also of FIG. 3.

The stainless steel transfer posts 308*a* are flanged and extend from the top plate 30 into the Box 70. Therefore, the second part of the button contact assembly 300*a* focuses on the Box or electronic housing 70 area. A neoprene washer, such as 310*a* is placed around the transfer post 308*a* adjacent to the flanged portion of the transfer post 308*a* and adjacent to the bottom surface 72*a* of the counterbore of the box 70. A nylon sleeve, such as 312*a* shown in FIG. 9, is next placed around the transfer post 308*a* for insulation purposes, followed by insertion of a stainless steel bridge spring, such as 314*a*, into the transfer post 308*a* itself. The spring, such as 314*a*, acts to further stabilize the transfer post 308*a* into the Box 70 of the apparatus 10 and to provide a conductive path from the interface PCB (not shown), to the stainless steel transfer post 308*a*. The contact button 300*a* is then sandwiched between the top plate 30 and the box 70. This type of button contact 300*a* number ensures a reliable and safe electrical contact to each Type classified round, such as 80 or 81, which is generally impervious to most environmental conditions encountered during a given military training exercise.

After the latches, such as latches 60 and 61 are engaged, center-to-center alignment of the Type classified round, such as 80 or 81, and button contact 300*a* are automatically secured by of the aforementioned guide bolts 90. When properly engaged, the magazine 20 is fully locked onto the Box 70. This procedure allows the three safety interlocks 28 located on the underside of the magazine 20 to complete the circuitry in the housing 70 wired for arming, and also created the necessary contact to efficiently contact the electrodes 404 and 406 of each Type classified round, such as round 80, or electrodes 407 and 409 of each Type Classified round, such as round 81, with the corresponding contact pads 302*a* and 304*a* respectively.

Printed circuit board assemblies (not shown) and interface printed circuit board (not shown) are hermetically sealed within the Box or electronic housing 70. The design of the circuit board allows the Type classified round 70 to be fired in a given sequence, or in sub-group sequences commonly known as partitioning. An external 12 volts DC power source typically must be provided by the user and power to the apparatus 10 is controlled by an on/off toggle switch 52. The apparatus 10 can also accommodate a 24 volts DC power source if required by the end user.

Upon initially engaging the apparatus 10 and applying power via the toggle switch 52 a predetermined time interval (such as sixty seconds) typically accrues before the apparatus 10 is armed, provided that the magazine 20 is properly latched, prior to type classified round ignition for safety reasons. During the sixty seconds the electronics in the electronic housing 70 perform a self-diagnostics routine and if any shorted output transistors on the control PCB (not shown) within the electronic enclosure 70 are encountered the apparatus 10 will not arm. During this time the unit (apparatus 10) also scans the magazine 20 to determine where there are rounds and if any were previously fired. The locations are placed in memory located on the control PCB in the electronics housing 70 for later use. The purpose for this function is so that when a fire command is given there will always be a detonation until the entire magazine 20 is spent. The apparatus 10 will not attempt to fire a spent round or empty location.

In the preferred embodiments, the apparatus 10 contains both a visible light 53 and audio warning, which is a piezo beeper (not shown) on the control PCB, to indicate arming of the apparatus 10 and to indicate the program mode and any error that is encountered after the self diagnostics is performed. The circuitry may provide for self-testing and will enunciate fault codes to the operator in the event a fire invalidate situation is encountered.

The "P1 Input" connector 55 connects to circuitry to accommodate the external battery power and ignition sequence signals supplied during a given training exercise. The "P2 Output connector" or "Tandem" connector 51 allows the apparatus 10 to be "daisy-chained" to operate other units, each like apparatus 10, in tandem for greater training flexibly and round volume capability. The "P3 Mode" or "program select" connector 56 connects to the required circuitry to allow the operator to pre-program a plurality of firing sequences, such as up to fifteen different firing sequences. In addition, the circuitry in the housing 70 allows the apparatus 10 to be programmed to perform special applications such as anti-personal and anti-tank training, mine dispensing simulation, car or truck simulation, Claymore mine simulation and Military Operations on Urban Terrain or MOUT training. Another unique feature of the circuitry in the housing 70 of apparatus 10, is the ability to fire multiple rounds 80 or 81 with a single fire command giving an even greater audible and visual effect. Any number or all rounds can be fired from a single fire command.

The electrical current required to fire a round, such as round 80 or 81, may be six amps and the duration may be fifty milliseconds. The standby current for the apparatus 10 may be 100 milliamps. That is the current that flows through the apparatus 10 at a no fire condition. The apparatus 10 may have a 12 or 24 Volts DC power source.

An electrical signal generated by a remote radio frequency controller may control the operation of the apparatus 10. A radio frequency controller may receive the signal to fire and may pass it along to the apparatus 10 via the input connector 55. An existing known radio frequency controller used as military equipment may be used for this purpose. An operator in a control tower may send a fire signal to the apparatus 10 located adjacent to a fake tank for example via radio control and may tell the fake tank to hostile fire at the trainee. The simulated hostile fire is achieved through the use of apparatus 10 which is positioned on or near the ground next to the fake tank. The trainee in turn must be able to recognize hostile fire and take action and fire at the fake tank target with either life ammunition or simulated ammunition. If the fake tank target is hit by the trainee the apparatus 10 next to the fake tank target is given another fire command to fire and simulate that the target was hit. Multiple hits to the target by the trainee would be simulated by another fire command given to the apparatus 10 which in turn signifies to the trainee that the fake tank target was killed and is inoperable and no longer a hostile threat. The capacity of the apparatus 10 may be thirty rounds of M30 and/or M31 Type classified rounds.

In one embodiment of the present invention if a fire command is given the apparatus 10 will fire rounds one through thirty in that order. If however a hit/kill command is given (at any time before the twentieth round is fired) the apparatus 10 will automatically partition itself into two zones first through twentieth and twenty-first through thirtieth and fire the first of the twenty-first through thirtieth zone. When the apparatus 10 is partitioned in this manner any time a fire command is given the next available round in the first through twentieth zone will fire and any time a hit/kill command is given the apparatus 10 will fire the next available round in the twenty-first through thirtieth zone. The purpose for this is so a fake tank target can hostile fire and also smoke to show a kill when the target is hit by the trainee.

Sometimes at great distances (probably over 5 Km) a single round may not produce a sufficient signature to be seen so the present invention in one or more embodiments provides the capability to fire two or more rounds at once to give a greater effect.

The LEDs 53 and 54 may blink when the apparatus is armed or arming respectively. The term "arm" means that the apparatus 10 has gone through self-diagnostics, through the round scan, and timed out for sixty seconds, so it is ready to fire. The term "armed" means "Stay away"!. The operator may have control of the device via an ON/OFF Switch 52. There may be fault codes which may be visually indicated by a blinking LED and an audible alarm to annunciate the fault code via series of beeps which are produced by the piezo beeper on the control PCB inside the box 70. Smoke from the apparatus 10 after firing a round may be see for 3,000 meters with the unaided eye. The Audio-bang or sound from firing the apparatus 10 may be 135 dB average at 2 meters away from the apparatus 10.

The apparatus 10 can be programmed to perform special applications such as; anti-Personnel and anti-tank mine dispensing simulation, car or truck bomb simulations, Claymore Simulation and, Urban MOUT Military Operations on Urban Terrain. Two or more devices, like apparatus 10, may be operated in tandem. The apparatus 10 may be compatible with current ATKS/GUFS Armored Tank Kill Simulator/Gun Fire Simulator future NGATS New Generation Armored Tank Simulator and I-NGATS Improved-New Generation Armored Tank Simulator.

Inside each round, such as round 80 in FIG. 12 or round 81 in FIG. 11, is an explosive powder, an electric match, and a bridgewire that goes between a positive and a negative electrode of the electric match. The powder creates the explosion of the round. The electric match is the primer that lights the powder and it is the electric match that ignites when the proper current is passed through the electrodes on the bottom of the round that in turn ignites the explosive powder to create the explosion. The bridgewire is responsible for igniting the material that forms the electric match. When the proper current is applied to the positive and negative electrodes of the round, which are connected to the positive and negative sides of the electric match, the bridgewire which runs between the positive and negative of the electric match glows red hot. When the bridgewire glows red hot it ignites the match material and the match material ignites the powder to create the explosion. A firing unit, such as apparatus 10 of one embodiment of the present invention, can safely detect the presence of the bridgewire so that the firing unit can determine that a round is in fact in the chamber, such as chamber 23 of the magazine 20 and ready to fire. It is the bridgewires that the firing unit, such as apparatus 10, scans for to determine where in the magazine, such as magazine 20, there are rounds and which ones have already been fired. Normally when the proper current is passed through the electrodes to ignite the match and create the explosion the current will also burn out the bridgewire so that there is no more electrical continuity in that round and if it were inadvertently left in the magazine during a magazine scan that particular round would not be "seen" by the scan function. So in effect the unit, such as apparatus 10, would think that that particular chamber, such as chamber 23, in the magazine, such as magazine 20, was empty and when the fire command is received by the unit, such as apparatus 10, would skip over that location and fire the next in line to ensure that something fired.

When multiple rounds are fired by the apparatus 10, apparatus 10 typically fires one at a time but in a very rapid fire sequence. This is done because the battery used with apparatus 10 can only produce so much energy at once. The time between firing may be typically approximately thirty milliseconds so that to human eyes and ears it looks and sounds like one bigger explosion. Since the apparatus 10 typically fires with such a short interval in between shots it is able to create enough electrical energy to ignite the match but not enough to burn out the bridgewire. The bridgewire typically remains intact. The bridgewire typically needs a longer sustained amount of energy to burn out, such as a slow blow fuse. If inadvertently some previously fired rounds with the bridgewire intact are left in their chambers and the apparatus 10 is re-initialized (power turned off and back on again to force a chamber scan) the apparatus 10 would think that there were unfired rounds in those positions and attempt to fire the already fired rounds when given the fire command and obviously nothing would happen, i.e. a misfire. A misfire of any type is not acceptable. A solution to this problem is as follows. There is approximately a two second interval after a round or a number of rounds are fired that the apparatus 10 cannot fire again. This is part of the design criteria and is used to prevent false firing. So what is done in one embodiment of the present invention is to use that two second interval or timeout to go back to whatever chambers were previously fired and apply enough electrical energy to burn out the bridgewire. Since the particular rounds were already fired there is no explosion just the bridgewire is burned out which produces no visual or audible feedback. This may be called the "afterburn circuit".

The following document describes the relevant circuitry of the apparatus 10 inside the electronic housing 70 of the Pacific Coast System LLC MPT-30 and MPT-60 Multi-purpose Pyrotechnic Trainer circuitry in regard to characteristics which are unique to the devices. In at least some respects the function of the circuitry within the electronic housing 70 is not unique since it is compatible with (ATKS/GUFS Army Tank Kill Simulator/Gun Fire Simulator). These are older systems that the apparatus 10 is designed to replace with many enhancements of course one of them being the ability to fire multiple rounds per que (fire command). The apparatus 10 may have automatic chamber scan. This means that upon power up, the apparatus 10 will scan all chambers to determine whether a round is present by testing a bridgewire which is not shown. A bridgewire is typically inside of each pyrotechnic round. The process of sensing the presence of the bridgewire is already being done by other manufacturers' units known in the art.

The apparatus 10 may have "multiple rounds per que (fire command)". This feature is of utmost importance since the apparatus 10 is the only type of device with this capability. Many users of existing pyrotechnic launchers have expressed disappointment with the M30 or M31 Flash/Bang round due to its' low db and smoke signature. Firing multiple rounds per que (fire command) increases the audible and visual signature. Doing so requires the following:

The "Fire" command must not exceed 30 milliseconds else the multiple firing will not sound simultaneous. Normally, as with the ATKS (Army Tank Kill Simulator), a 200 millisecond command is standard causing a "machine gun" effect.

After firing the M30 or M31 round with a 30 millisecond command pulse, the circuit inside the electronic housing 70 must, after ignition, return power to the round for 500 milliseconds at 6.0 Amperes in order to burn the bridgewire inside of particular round, such as round 80, of the electric match inside the particular round, such as round 80. Should this not be done, the Automatic Chamber Scan feature would not operate properly since 30 milliseconds is enough time to ignite a round, but not to open circuit the bridgewire. This would cause the apparatus 10 to sense a spent round with a continuous (not open) bridgewire as a viable round. This would be a serious flaw.

Whether firing single or multiple rounds per que, the circuit inside the electronic housing 70 will always return to the last round(s) fired and attempt to refire. If a new fire command is received during this time, the new command will have priority before the "refire" begins again. All rounds will be refired for 500 milliseconds at 6.0 Amperes in order to positively "open circuit" the electric match bridgewire.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A pyrotechnic device adapted to fire blank ammunition rounds for the purpose of simulating weapons firing and/or hit indications, comprising a magazine having a top surface, a bottom surface and a plurality of receptacles extending through said magazine from said top surface thereof to said bottom surface thereof, each of said receptacles including a first boring positioned adjacent said top surface and having a first diameter, a second boring positioned adjacent said bottom surface and having a second diameter, which is greater than said first diameter, and a third boring positioned between said first boring and said second boring, said third boring having a third diameter, which is greater than said first diameter but less than said second diameter, said first, second and third diameters being selected such that each of said receptacles can selectively and interchangeably receive at least two different types of blank ammunition rounds.

2. The pyrotechnic device of claim 1, wherein said first diameter is selected so as to accommodate a component of a first type of blank ammunition round or a component of a second type of blank ammunition round, said second diameter is selected so as to accommodate another component of the first type of blank ammunition round, and said third diameter is selected so as to accommodate another component of the second type of blank ammunition round.

3. The pyrotechnic device of claim 2, wherein the first type of blank ammunition round is an M30 pyrotechnic ammunition device. and the second type of blank ammunition round is an M31 pyrotechnic ammunition device.

4. The pyrotechnic device of claim 1, further comprising a housing, having an interior sized and shaped so as to contain circuitry adapted to produce programmable firing sequences for blank ammunition rounds contained within said receptacles of said magazine, and a top plate having a first side positioned adjacent said housing and a second side, which is opposite said first side, positioned adjacent said bottom surface of said magazine, said top plate including a plurality of electrical contact assemblies located on said second side of said top plate such that each of said contact assemblies is in substantial alignment with a corresponding one of said receptacles, whereby said contact assemblies are adapted to transmit electric current to blank ammunition rounds contained in said receptacles.

5. The pyrotechnic device of claim 4, wherein each of said contact assemblies includes a central contact pad which forms part of an electrical path between said circuitry and a center contact pin of a blank ammunition round which has been loaded into a corresponding one of said receptacles, and an annular contact disc, which encircles said central contact pad and which forms part of an electrical path between said circuitry and an outer contact post of a blank ammunition round which has been loaded into said corresponding one of said receptacles.

6. The pyrotechnic device of claim 5, wherein said annular contact disc is made from electrically conductive rubber, whereby said annular conductive disc allows for variations in the length of outer contact posts on different blank ammunition rounds.

7. The pyrotechnic device of claim 6, wherein said central contact pad is made from electrically conductive rubber.

8. The pyrotechnic device of claim 5, wherein each of said contact assemblies further includes electrical insulation positioned between said annular contact disc and said central contact pad.

9. The pyrotechnic device of claim 4, wherein each of the different types of blank ammunition rounds includes an explosive powder, an electric match having a positive electrode and a negative electrode, and a bridgewire connecting the positive and negative electrodes.

10. The pyrotechnic device of claim 9, wherein said circuitry generates a first electric current for a first period of time sufficient to ignite the explosive powder contained in a blank ammunition round to be fired from one of said receptacles of said magazine, and said circuitry generates a second electric current for a second period of time sufficient to burn out the bridgewire of the ignited blank ammunition round.

11. The pyrotechnic device of claim 10, wherein each of said contact assemblies includes a central contact pad which forms part of an electrical path between said circuitry and a center contact pin of a blank ammunition round which has been loaded into a corresponding one of said receptacles, and an annular contact disc, which encircles said central contact pad and which forms part of an electrical path between said circuitry and an outer contact post of a blank ammunition round which has been loaded into said corresponding one of said receptacles.

12. The pyrotechnic device of claim 11, wherein said annular contact disc is made from electrically conductive rubber, whereby said annular conductive disc allows for variations in the length of outer contact posts on different blank ammunition rounds.

13. The pyrotechnic device of claim 12, wherein said central contact pad is made from electrically conductive rubber.

14. The pyrotechnic device of claim 13, wherein each of said contact assemblies further includes electrical insulation positioned between said annular contact disc and said central contact pad.

15. The pyrotechnic device of claim 1, wherein said first diameter is about 1.121 inches, said second diameter is about 1.337 inches and said third diameter is about 1.263 inches.

* * * * *